US006234388B1

(12) United States Patent
Taylor

(10) Patent No.: US 6,234,388 B1
(45) Date of Patent: May 22, 2001

(54) SECURITY MAILBOX

(76) Inventor: Gary L. Taylor, 715 S. Upas St., Escondido, CA (US) 92025

( * ) Notice: Subject to any disclaimer, the term of this patent is extended or adjusted under 35 U.S.C. 154(b) by 0 days.

(21) Appl. No.: 09/255,435

(22) Filed: Feb. 22, 1999

(51) Int. Cl.[7] ..... B65G 11/04
(52) U.S. Cl. ..... 232/47; 232/17
(58) Field of Search ..... 232/47, 45, 17, 232/43.1

(56) References Cited

U.S. PATENT DOCUMENTS

| | | | | |
|---|---|---|---|---|
| 42,052 | | 3/1864 | Springer . | |
| 192,146 | | 6/1877 | Bragaldi . | |
| D. 321,075 | | 10/1991 | Scott . | |
| 516,890 | * | 3/1894 | Hentz | 232/47 |
| 516,891 | * | 3/1894 | Hentz | 232/47 |
| 686,328 | | 11/1901 | Plank . | |
| 997,478 | | 7/1911 | Toomy . | |
| 1,049,058 | | 12/1912 | Davis . | |
| 1,227,934 | | 5/1917 | Riegg . | |
| 1,480,452 | | 1/1924 | Kolstad . | |
| 1,664,462 | | 4/1928 | Muehleisen . | |
| 1,992,640 | | 2/1935 | Steen . | |
| 1,994,186 | | 3/1935 | Anderson . | |
| 2,477,276 | | 7/1949 | Walton . | |
| 2,602,584 | | 7/1952 | Croft, Jr. . | |
| 2,781,964 | | 2/1957 | Ledgerwood . | |
| 2,963,168 | | 12/1960 | Wilson . | |
| 3,070,234 | | 12/1962 | Deitchman . | |
| 3,401,875 | | 9/1968 | Bruhns . | |
| 3,735,919 | | 5/1973 | Morgan . | |
| 3,758,027 | | 9/1973 | Morgan . | |
| 3,802,619 | | 4/1974 | Leigh Products, Inc. et al. . | |
| 3,874,583 | | 4/1975 | Moll . | |
| 3,880,344 | | 4/1975 | Earle . | |
| 3,960,317 | | 6/1976 | Clement . | |
| 4,121,758 | | 10/1978 | Bonner . | |
| 4,186,896 | | 2/1980 | Brandenberger et al. . | |
| 4,382,540 | | 5/1983 | Kelly et al. . | |
| 4,905,891 | | 3/1990 | Wildish et al. . | |
| 4,993,626 | | 2/1991 | Berry . | |
| 5,000,378 | | 3/1991 | Dorr et al. . | |
| 5,096,115 | | 3/1992 | Hassan . | |
| 5,143,284 | | 9/1992 | Socarras . | |
| 5,148,974 | | 9/1992 | Clapper . | |
| 5,351,883 | | 10/1994 | Pachl . | |
| 5,400,960 | | 3/1995 | Jeffs . | |
| 5,435,484 | | 7/1995 | Carlson . | |
| 5,833,132 | * | 11/1998 | Bachmeier | 232/43.1 X |
| 5,938,113 | * | 8/1999 | Kim | 232/47 |

* cited by examiner

*Primary Examiner*—Lynne H. Browne
*Assistant Examiner*—William L. Miller
(74) *Attorney, Agent, or Firm*—Calif Tervo

(57) ABSTRACT

Security mailbox (10) comprises: enclosure (11) having incoming chamber (12) and secured chamber (13); rocker plate (90), pivotally mounted about pivot axis (99) within enclosure (11), separating incoming chamber (12) and secured chamber (13), and pivotable between receiving position (98R) and drop position (98D); and a stop (14), interacting between enclosure (11) and rocker plate (90), for stopping rocker plate (90) in receiving position (98R). Rocker plate (90) is biased toward receiving position (98R) and pivots to drop position (98D) either through increased moment on rear section (94) of rocker plate (90) exerted by received mail or through interaction between flair (101) in front end (91E) of rocker plate (90) and door (26). Rocker plate (90) is also manually pivotable by exerting upward moment on front section (91) of rocker plate (90) with user's hand or finger.

22 Claims, 2 Drawing Sheets

SECURITY MAILBOX

FIELD OF THE INVENTION

This invention relates to mailboxes generally, and more particularly to a security mailbox which prevents the theft or the destruction of the mail and packages deposited therein.

BACKGROUND OF THE INVENTION

Conventional mailboxes are typically not secure by design. When a letter carrier delivers correspondence or small packages to a conventional mailbox, the items deposited therein remain within easy reach, and sometimes even within obvious view, of casual passers-by. Anyone desiring to examine or to procure the contents of such a mailbox need overcome no significant physical barriers in order to gain access to incoming or outgoing mail placed there.

Conventional mailboxes are also typically not designed to hold more than one or two days' mail deliveries. During even a short vacation or hospital stay, mail can fill an absent homeowner's conventional mailbox and overflow such that further deliveries by the letter carrier are no longer practical or possible.

Though many mailboxes are equipped with doors, flaps, or other closure elements, they are nevertheless inadequate with respect to protecting their contents from inclement weather when the mailbox is very full such that the door cannot close properly.

There has been a continuing need, therefore, for an effective enclosure for receiving and temporarily storing delivered mail in such a way as to protect it from the elements and to prevent its theft. A security mailbox designed to meet these needs should be simply constructed with minimal moving parts and at the same time should be made to conform with the strict requirements of the postal service.

SUMMARY OF THE INVENTION

This invention is a mailbox which secures the items deposited therein from theft and protects its contents from the elements. The security mailbox generally comprises an enclosure having an incoming chamber adapted for receiving mail through a mail delivery opening in its front end and a secured chamber having an access door for selectively accessing delivered mail items secured therein. A rocker plate is pivotally mounted on a pivot axis within the enclosure and has a rear section on one side of the pivot axis and a front section on the other side of the pivot axis.

The rocker plate separates the incoming chamber from the secured chamber and pivots between a receiving position, in which the front section of the rocker plate is disposed proximal the front end of the incoming chamber for receiving mail deposited through the opening, and a drop position, in which the front section-of the rocker plate is raised relative to its back section, causing the items placed upon the rocker plate to slide into the secured chamber.

The rocker plate is biased toward the receiving position, and a stop interacts between the enclosure and the rocker plate for stopping the rocker plate in the receiving position. The security mailbox of the present invention is adapted such that the front section of the rocker plate may be manipulated by hand to pivot the rocker plate into the drop position.

The enclosure, the chambers, and the rocker plate are so dimensioned as to prevent a would-be thief from gaining access to the contents of the secured chamber through the mail delivery opening in the front of the incoming chamber. In the receiving position, the rocker plate is substantially horizontal and closes off most of the secured chamber, thereby restricting access to the secured chamber from the opening in the front of the incoming chamber. In the drop position, the rocker plate closes off most of the incoming chamber, thereby restricting access to the secured chamber from the opening in the incoming chamber.

In an exemplary embodiment, the invention provides a door for closing the opening in the front end of the incoming chamber to protect the contents of the enclosure from inclement weather.

Other features and many attendant advantages of the invention will become more apparent upon a reading of the following detailed description together with the drawings in which like reference numerals refer to like parts throughout.

DETAILED DESCRIPTION OF THE INVENTION

Figure 2:
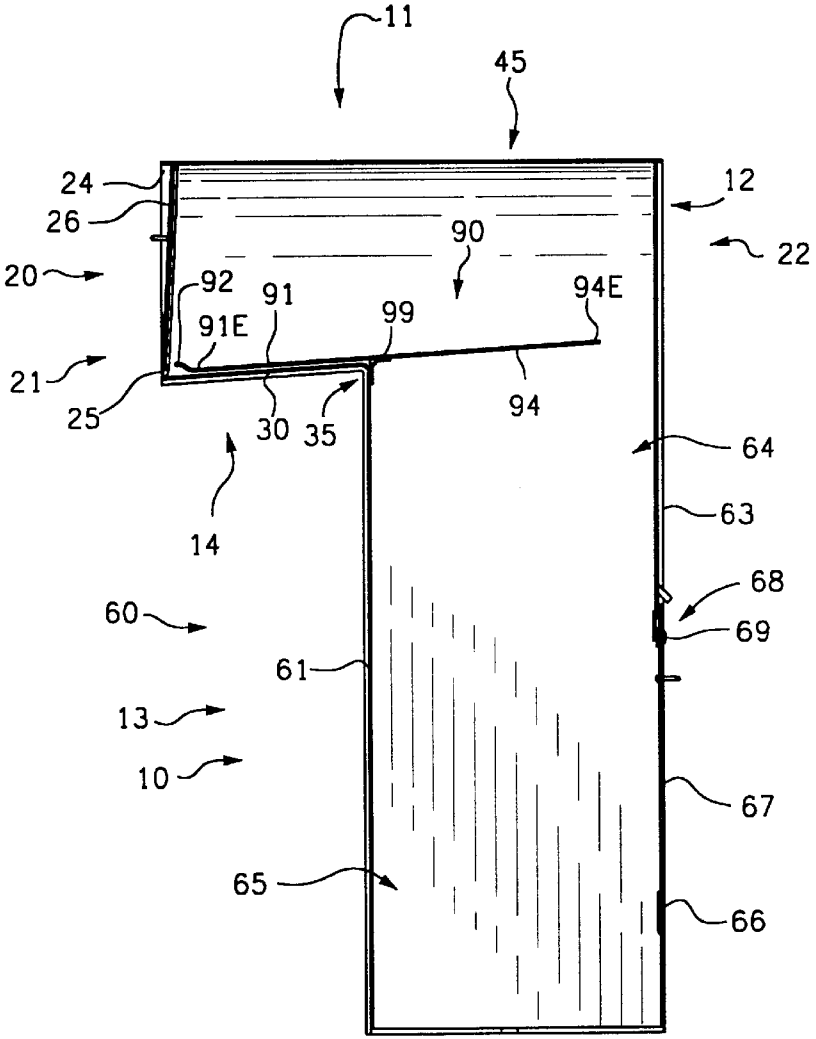
FIG. 2 is a right side cross-sectional view of a first preferred embodiment of the invention taken on the line 2—2 in FIG. 1.
Figure 1:
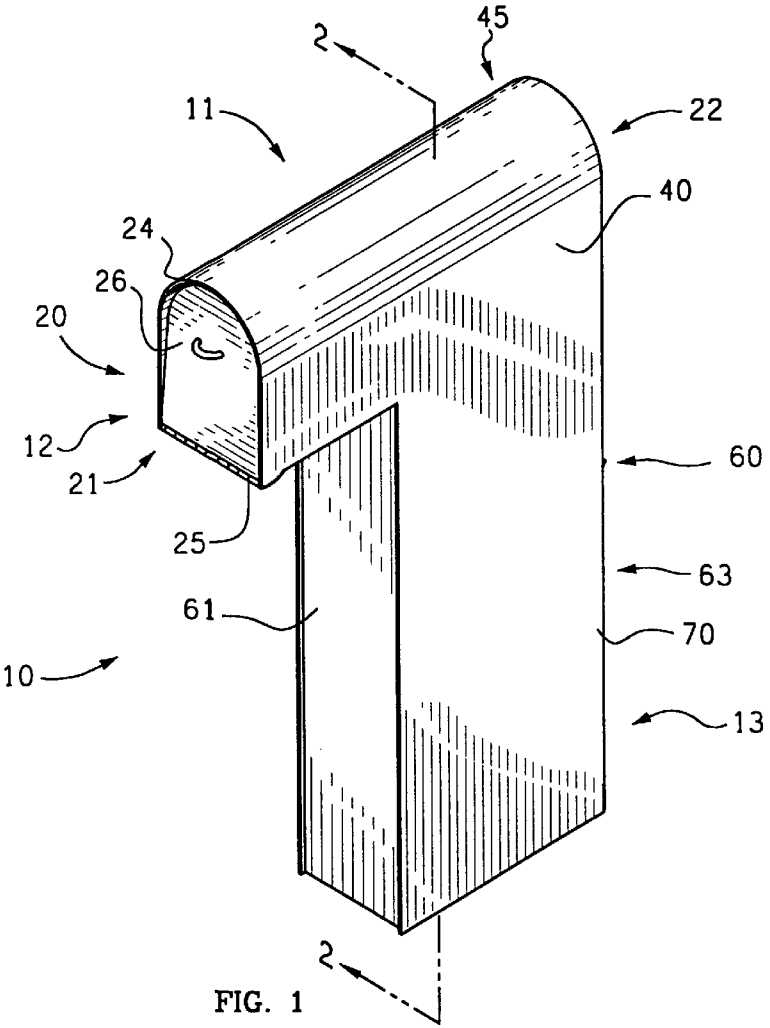
FIG. 1 is a perspective view of the security mailbox of the invention.

With reference now to the drawings, particularly FIGS. 1 and 2 thereof, there is shown, in FIG. 1, a perspective view of the 1; security mailbox 10 of the invention and, in FIG. 2, a right side cross-sectional view of a first preferred embodiment taken on the line 2—2 in FIG. 1.

Security mailbox 10 comprises an enclosure 11 having an incoming chamber 12, such as receiving section 20, adapted for receiving deliveries of mail and a secured chamber 13, such as storage section 60, adapted for storing delivered mail and protecting it from theft or harsh weather conditions. Rocker plate 90 is pivotally mounted, such as by a hinge pivot, on a pivot axis 99 within enclosure 11 and separates receiving section 20 from storage section 60. Rocker plate 90 simultaneously serves to prevent a person's arm from reaching into storage section 60 from the opening in front end 21 of receiving section 20 and to communicate delivered mail from receiving section 20 to storage section 60. Rocker plate 90 includes a rear section 94, having a back end 94E, to one side of pivot axis 99 and a front section 91, having a front end 91E, on the other side of pivot axis 99. Stop means 14, such as bottom plate 30 of receiving section 20, interacting between enclosure 11 and rocker plate 90, are included for stopping rocker plate 90 in a desired position. Stop means 14 can be made to interact with either front section 91 or rear section 94 of rocker plate 90, and may constitute part of enclosure. 11, such as bottom plate 30, or may be formed as projections on the interior surfaces of opposed side walls 40 or bottom plate 30.

Figure 4:
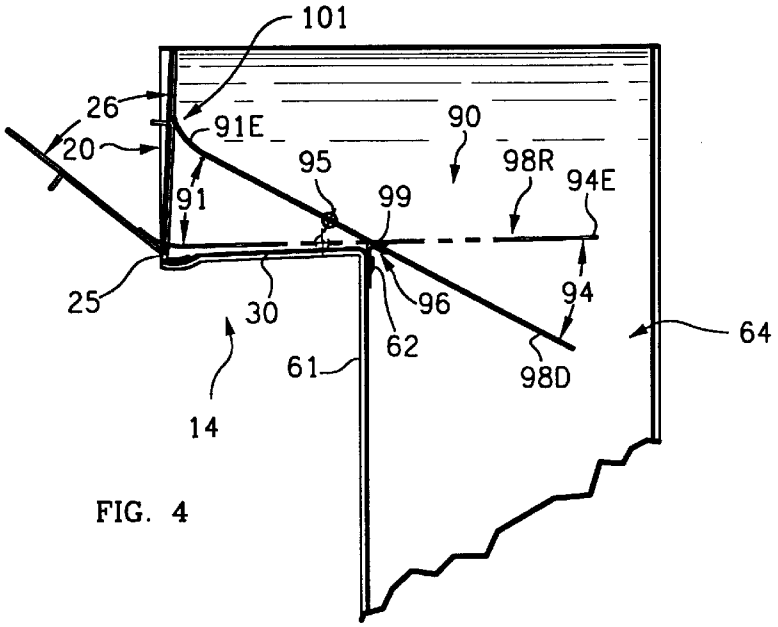
FIG. 4 is a partial right side cross-sectional view showing a second preferred embodiment of the invention.
Figure 3:
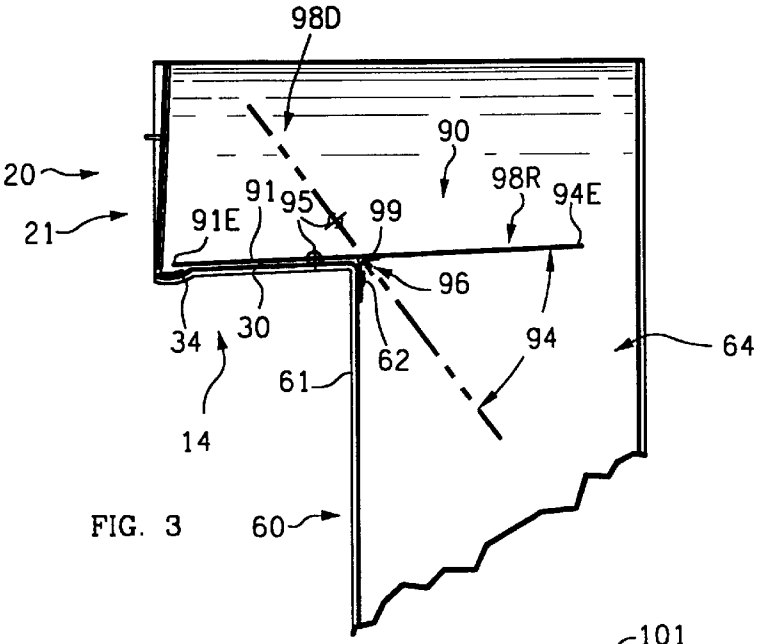
FIG. 3 is a partial right side cross-sectional view of a version of the embodiment shown in FIG. 2 and further showing, in phantom, a preferred embodiment of a rocker plate in the drop position.
Figure 5:
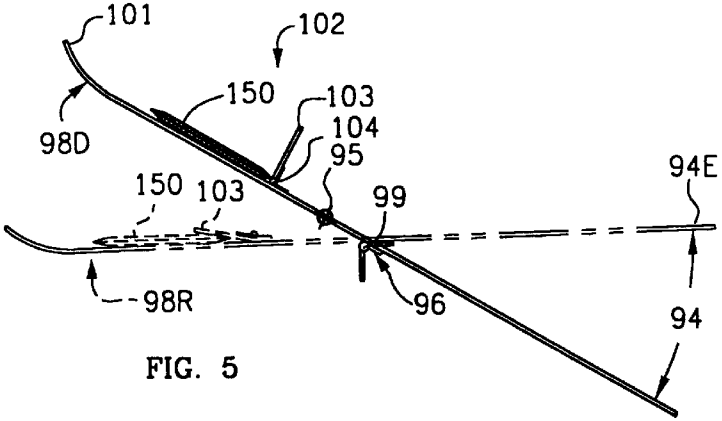
FIG. 5 is an enlarged view of the rocker plate of FIG. 4 further including outgoing mail detention means.

In use, mailbox 10 is adapted such that a user's hand or finger may lift up on front section 91, such as at front end 91E, 1t of rocker plate 90 and thereby manually pivot rocker plate 90 such that items placed thereupon are slidably deposited into storage section 60. One embodiment of such an adaptation is shown in FIG. 2, where front end 91E of front section 91 is shown equipped with a raised lip section 92. A second embodiment is shown in FIG. 3, where front end 91E of rocker plate 90 extends over finger recess 34 in bottom plate 30. A third embodiment is shown in FIGS. 4 and 5, where front section 91 of rocker plate 90 includes an up-raised portion, flair 101. In each illustrated embodiment, raised lip section 92, finger recess 34, and flair 101 all provide a user with easy access to the bottom surface of rocker plate 90, allowing the user to lift up on front section 91.

Looking more closely at FIGS. 1 and 2, receiving section 20 has a back wall 22 and a front end 21 having a mail delivery opening, shown closed off by door 26, for receiving mail therethrough. Opposed side walls 40, extending upward from bottom plate 30, and back wall 22 are connected to top 45, defining receiving section 20. When door 26 is in the closed position as shown, top 45 extends forward of door 26 to create eave 24, which aids in weather-proofing receiving section 20. Note that while door 26 is shown hingably attached to front end 21 at hinge 25, other means of attaching door 26 are contemplated. For example, door 26 may be slidably attached, or door 26 may be hinged at a different location at front end 21.

Preferably, bottom plate 30 of receiving section 20 is sloped downward toward front end 21 such that any rain, snow, or moisture inadvertently introduced into receiving section 20 tends to move toward front end 21 away from storage section 60 and any outgoing mail placed upon rocker plate 90. This downward slope, best appreciated in FIGS. 2–5, helps weather-proof enclosure 11 and protect mail from moisture damage by preventing accumulation of standing water within receiving section 20 and storage section 60.

Storage section 60 includes a front wall 61, shown extending downward from back edge 35 of bottom plate 30, and opposed side walls 70, shown as coplanar with opposed side walls 40 of receiving section 20. Back wall 63 of storage section 60 includes access means, such as access door 67, allowing a user to access the contents of storage section 60. Access door 67 is shown hinged at hinge 66, but access to storage section 60 may be provided in other ways, such as with a slidable door or pivotable bin. Preferably, access door 67 includes locking means 68, such as a lock 69, integral with the closure mechanism. In another possible embodiment, not shown, locking means 68 may include a hasp integral with storage section 60 which extends through a slot in access door 67 adapted for use with an ordinary pad lock or combination lock.

Upper portion 64 and lower portion 65 of storage section 60 are identified in FIG. 2. Preferably, volume of storage section 60 is several times larger than receiving section 20 such that several days' mail accumulation can be accommodated entirely in lower portion 65 so as to allow rocker plate 90 to pivot freely in upper portion 64.

Turning now to FIG. 3 where the operation of rocker plate 90 is apparent, there is shown a partial right side cross-sectional view of a version of the embodiment shown in FIG. 2 and further showing, in phantom, a preferred embodiment of rocker plate 90 in the drop position 98D. In use, rocker plate 90, being pivotally mounted on rocker hinge 96 at pivot axis 99, is pivotable between a receiving position 98R and a drop position 98D. In receiving position 98R, front end 91E of rocker plate 90 is disposed proximal front end 21 of receiving section 20 such that front section 91 of rocker plate 90 is positioned so as to receive mail deposited in receiving section 20 through the mail delivery opening in front end 21. In drop position 98D, rocker plate 90 is positioned for dropping received mail into storage section 60.

Rear section 94, including back end 94E, of rocker plate 90 controls the communication of mail between receiving section 20 and storage section 60 by pivoting down into upper portion 64 of storage section 60. Front section 91 of rocker plate 90 has a moment greater than the moment of rear section 94 so as to bias rocker plate 90 toward receiving position 98R. This is easily accomplished by locating the center of gravity 95 of rocker plate 90 forward of pivot axis 99 as shown in FIGS. 3–5.

Stop means 14, such as bottom plate 30 of receiving section 20, for stopping rocker plate 90 in receiving position 98R interact between enclosure 11 and rocker plate 90 and prevent rocker plate 90 from pivoting forward past receiving position 98R. It is apparent throughout the FIGS. 2–5 that bottom plate 30, acting as stop means 14, interacts with front section 91 of rocker plate 90. However, the invention also contemplates stop means 14 interacting with rear section 94 of rocker plate 90, or stop means 14 other than a plate, such as projections on interior portions of opposing side walls 40 or a hinge 96 with a limited range of motion.

Incoming mail placed on rear section 94 of rocker plate causes rocker plate 90 to pivot toward drop position 98D, which causes incoming mail to slide toward back end 94E, which in turn increases the tendency of rocker plate 90 to pivot to drop position 98D. If mail deposited by a letter carrier upon rocker plate 90 creates a large enough moment on rear section 94 to overcome the moment on front section 91, rocker plate 90 will pivot to drop position 98D due to this increased moment on rear section 94 and thereby drop mail into storage section 60. If the deposited mail is not heavy enough or not placed close enough to back end 94E such that the moment on front section 91 is not overcome, the letter carrier need only lift up on front section 91, such as at front edge 91E, with a hand or finger to pivot rocker plate 90 to drop position 98D manually.

FIG. 2 shows a preferred embodiment of rocker plate 90 adapted for such manual manipulation. Raised lip section 92 located at front edge 91E of rocker plate 90 allows a user to lift up on bottom surface of front section 91, thereby pivoting rocker plate 90 to drop position 98D. In FIG. 3, this manual manipulation is facilitated by finger recess 34 in bottom plate 30. Front edge 91E of rocker plate 90 extends over finger recess 34, providing a user with easy access to bottom surface of front section 91.

Return bumper 62, such as of rubber or other compressible material, shown on inside surface of front wall 61 of storage section 60, absorbs impact of rear section 94 pivoting to drop position 98D and serves, along with the greater moment of front section 91 of rocker plate 90, to ensure that rocker plate 90 will return to receiving position 98R after incoming mail has been deposited in storage section 60.

FIGS. 3 and 4 show how the operation of rocker plate 90 effectively acts as a security device by preventing access from receiving section 20 to mail accumulating in storage section 60. Importantly, receiving section 20 and rocker plate 90 are so dimensioned as to prevent a person's arm from reaching into storage section 60 through the opening in front end 21 of receiving section 20. In the receiving position 98R, rocker plate 90 closes off most of the upper portion 64 of storage section 60 from the opening in front end 21 of receiving section 20. A person's arm cannot extend past back edge 94E of rear section 94 and reach down into storage section 60 without pivoting rocker plate 90 toward drop position 98D. As rocker plate 90 pivots to drop position 98D, however, front section 91 closes off most of receiving section 20 such that a person's arm cannot be used to reach mail in storage section 60.

FIG. 4 is a partial right side cross-sectional view showing a second preferred embodiment of the invention 10. In this second embodiment, front end 91E of rocker plate 90 is equipped with an up-raised portion, flair 101, which serves as an automatic drop means for pivoting rocker plate 90 to drop position 98D. Flair 101 is designed to interact with door 26 such that door 26 exerts an upward moment on front section 91 of rocker plate 90, thereby pivoting rocker plate 90 to drop position 98D automatically each time door 26 is closed such that incoming mail deposited upon rocker plate 90 slides off back edge 94E into storage section 60. Note that in FIG. 4 center of gravity 95 of rocker plate 90 is forward of pivot axis 99 such that rocker plate 90 remains biased toward receiving position 98R and tends to return to receiving position 98R each time door 26 is opened.

As an alternative to relying on the automatic drop means to pivot rocker plate 90 as a consequence of closing door 26, a letter carrier delivering mail may lift up on flair 101 to pivot rocker plate 90 to drop position 98D manually to ensure proper communication of mail to storage section 60.

Preferably, the second embodiment shown in FIG. 4 includes means for preventing outgoing mail from being dropped into storage section 60 automatically when door 26 is closed after outgoing mail has been placed upon rocker plate 90.

FIG. 5 is an enlarged view of the rocker plate 90 of FIG. 4 further including outgoing mail detention means 102.

A preferred embodiment of outgoing mail detention means 102 for preventing communication of outgoing mail 150 to storage section 60 includes detent plate 103 pivotally attached, such as by hinge 104, to rocker plate 90. As can be appreciated by the illustration in FIG. 5, when rocker plate 90 is in receiving position 98R, detent plate 103 pivots toward front edge 91E of rocker plate 90, and when rocker plate 90 is in drop position 98D, detent plate 103 pivots away from front edge 91E such that detent plate 103 is substantially perpendicular to plane of rocker plate 90. Detent plate 103 thereby prevents outgoing mail 150 from dropping into storage section 60 when rocker plate 90 pivots to drop position 98D. outgoing mail 150 intended for the letter carrier is placed under detent plate 103 when rocker plate 90 is in receiving position 98R when door 26 is open, as shown in phantom in FIG. 5. When door 26 is closed and rocker plate 90 pivots to drop position 98D, detent plate 103 pivots to form a barrier which prevents outgoing mail 150 from sliding toward back end 94E of rocker plate 90 where it would otherwise be deposited in storage section 60.

When the letter carrier arrives and opens door 26, rocker plate 90 returns to receiving position 98R wherein the letter carrier may retrieve outgoing mail 150 from under detent plate 103. Incoming mail is placed on top of detent plate 103 such that operation of detent plate 103 does not interfere with communication of incoming mail to storage section 60. Other embodiments of outgoing mail detention means 102, such as a simple spring clip, are contemplated though not shown.

Preferably, enclosure 11 and rocker plate 90 are constructed of strong, durable metal treated with a weather resistant coating, such as galvanized steel or weather-treated aluminum. Enclosure 11 and rocker plate 90 should have the strength, rigidity, and impact resistance offered by these metals commonly used in mailbox construction, but other materials that are also common in mailbox construction, such as strong plastics and fiber composites, are also acceptable. Return bumper 62 is preferably made of rubber or other compressible and resilient material and should also resist degradation due to weather exposure. Rocker plate 90 is preferably ridged from front to back such that the mail placed thereupon remains on the raised portions of the ridges and any moisture remains in the low portions, between the ridges, away from mail. Such low portions act as channels to carry moisture toward front end 21 of receiving section 20 due to downward slope of bottom plate 30.

Having described the invention, it can be seen that it provides a very convenient device for the efficient receipt and temporary storage of mail. Incoming mail is communicated away from the opening in front end 21 of receiving section 20 so as to protect it from inclement weather and prevent its theft. Storage section 60 accommodates much more mail than a conventional mailbox and is only accessible through a lockable access door 67.

Although particular embodiments of the invention have been illustrated and described, various changes may be made in the form, composition, construction, and arrangement of the parts without sacrificing any of their advantages. Therefore, it is to be understood that all matter herein is to be interpreted as illustrative and not in any limiting sense, and it is intended to cover in the appended claims such modifications as come within the true spirit and scope of the invention.

Having thus described my invention, I claim:

1. A Security Mailbox for receiving mail comprising:

an enclosure having:

an incoming chamber having a front end having an opening therein; and a secured chamber having access means for selectively accessing the contents therein;

a rocker plate pivotally mounted on a pivot axis within said enclosure and separating said chambers; said rocker plate being pivotable between a receiving position for receiving mail from said opening of said front end of said incoming chamber and a drop position for dropping received mail into said secured chamber; said rocker plate including:

a rear section on one side of the pivot axis having a back end adapted for controlling the communication of mail between said incoming chamber and said secured chamber; and a front section on the other side of the pivot axis having a bottom side and a front end disposed proximal said front end of said incoming chamber when said rocker plate is in the receiving position; said front section having a moment greater than the moment of said rear section so as to bias said rocker plate toward the receiving position; said front end of said rocker plate including a raised portion adapted for receiving a user's hand such that a user's hand may lift up on said front section of said rocker plate and thereby pivot said rocker plate to the drop position; and stop means interacting between said enclosure and said rocker plate for stopping said rocker plate in the receiving position.

2. The Security Mailbox of claim 1, further comprising closure means for selectively closing the opening in said front end of said incoming chamber.

3. The Security Mailbox of claim 1 wherein said incoming chamber further includes a bottom plate extending rearward from said front end.

4. The Security Mailbox of claim 3 wherein said bottom plate provides said stop means for stopping said rocker plate in the receiving position.

5. The Security Mailbox of claim 3 wherein said bottom plate is downwardly sloped toward said front end of said incoming chamber.

6. The Security Mailbox of claim 1 wherein said incoming chamber and said rocker plate are so dimensioned as to prevent a person's arm from reaching into said secured chamber through the opening in said front end of said incoming chamber.

7. A Security Mailbox for receiving mail comprising:

an enclosure having:

an incoming chamber having a front end having an opening therein and including a bottom plate extending rearward from said front end; and a secured chamber having access means for selectively accessing the contents therein;

a rocker plate pivotally mounted on a pivot axis within said enclosure and separating said chambers; said rocker plate being pivotable between a receiving position for receiving mail from said opening of said front end of said incoming chamber and a drop position for dropping received mail into said secured chamber; said rocker plate including:

a rear section on one side of the pivot axis having a back end adapted for controlling the communication of mail between said incoming chamber and said secured chamber; and a front section on the other side of the pivot axis having a bottom side and a front end disposed proximal said front end of said incoming chamber when said rocker plate is in the receiving position; said front section having a moment greater than the moment of said rear section so as to bias said rocker plate toward the receiving position; and stop means interacting between said enclosure and said rocker plate for stopping said rocker plate in the receiving position; wherein said bottom plate includes a recess under said front section of said rocker plate adapted for receiving a user's hand such that a user's hand may lift up on said front section of said rocker plate and thereby pivot said rocker plate to the drop position.

8. The Security Mailbox of claim 7, further comprising closure means for selectively closing the opening in said front end of said incoming chamber.

9. The Security Mailbox of claim 7 wherein said bottom plate provides said stop means for stopping said rocker plate in the receiving position.

10. The Security Mailbox of claim 7 wherein said bottom plate is downwardly sloped toward said front end of said incoming chamber.

11. The Security Mailbox of claim 7 wherein said incoming chamber and said rocker plate are so dimensioned as to prevent a person's arm from reaching into said secured chamber through the opening in said front end of said incoming chamber.

12. A Security Mailbox for receiving mail comprising:

an enclosure having:

an incoming chamber including:

a front end having an opening therein; and a front door including:

a inner side; and a lower end hingedly attached to said front end of said incoming chamber such that said front door is movable between an open position opening said opening and a closed position closing said opening; and a secured chamber having access means for selectively accessing the contents therein;

a rocker plate pivotally mounted on a pivot axis within said enclosure and separating said chambers; said rocker plate being pivotable between a receiving position for receiving mail from said opening of said front end of said incoming chamber and a drop position for dropping received mail into said secured chamber; said rocker plate including:

a rear section on one side of the pivot axis having a back end adapted for controlling the communication of mail between said incoming chamber and said secured chamber; and a front section on the other side of the pivot axis having a bottom side and a front end disposed proximal said front end of said incoming chamber when said rocker plate is in the receiving position; said front section having a moment greater than the moment of said rear section so as to bias said rocker plate toward the receiving position; and stop means interacting between said enclosure and said rocker plate for stopping said rocker plate in the receiving position when said front door is in the open position; wherein:

upon moving said front door from the open position to the closed position, said inner side of said front door lifts on said bottom side of said front section of said rocker plate and pivots said rocker plate to the drop position.

13. The Security Mailbox of claim 12 wherein said incoming chamber further includes a bottom plate extending rearward from said front end and wherein said bottom plate provides said stop means for stopping said rocker plate in the receiving position.

14. The Security Mailbox of claim 13 wherein said bottom plate is downwardly sloped toward said front end of said incoming chamber.

15. The Security Mailbox of claim 12 further comprising outgoing mail detention means within said incoming chamber for preventing outgoing mail from dropping into said secured chamber.

16. The Security Mailbox of claim 12 wherein said incoming chamber and said rocker plate are so dimensioned as to prevent a person's arm from reaching into said secured chamber through the opening in said front end of said incoming chamber.

17. A Security Mailbox for receiving mail comprising:

an enclosure having:

an incoming chamber including:

a front end having an opening therein; and closure means for selectively closing the opening in said front end of said incoming chamber; and a secured chamber having access means for selectively accessing the contents therein;

a rocker plate pivotally mounted on a pivot axis within said enclosure and separating said chambers; said rocker plate being pivotable between a receiving position for receiving mail from said opening of said front end of said incoming chamber and a drop position for dropping received mail into said secured chamber; said rocker plate including:

a rear section on one side of the pivot axis having a back end adapted for controlling the communication of mail between said incoming chamber and said secured chamber; and a front section on the other side of the pivot axis having a bottom side and a front end disposed proximal said front end of said incoming chamber when said rocker plate is in the receiving position; said front section having a moment greater than the moment of said rear section so as to bias said rocker plate toward the receiving position;

stop means interacting between said enclosure and said rocker plate for stopping said rocker plate in the receiving position; and outgoing mail detention means attached to said rocker plate for preventing outgoing mail on said rocker plate from dropping into said secured chamber; said mailbox including a space under said bottom of said front section of said rocker plate for receiving a user's hand such that a user's hand may lift up on said bottom of said front section of said rocker plate and thereby pivot said rocker plate to the drop position.

18. The Security Mailbox of claim 17 further including:

automatic drop means, interacting between said incoming chamber closure means and said front end of said front section of said rocker plate, for automatically pivoting said rocker plate to the drop position when said incoming chamber closure means is engaged to close the opening in said front end of said incoming chamber.

19. The Security Mailbox of claim 17 wherein said incoming chamber further includes a bottom plate extending rearward from said front end and downwardly sloped toward said front end; and wherein said bottom plate provides said stop means for stopping said rocker plate in the receiving position.

20. The Security Mailbox of claim 17 wherein said incoming chamber and said rocker plate are so dimensioned as to prevent a person's arm from reaching into said secured chamber through the opening in said front end of said incoming chamber.

21. A Security Mailbox for receiving mail comprising:

an enclosure having:

an incoming chamber including:

a front end having an opening therein; and closure means for selectively closing the opening in said front end of said incoming chamber; and a secured chamber having access means for selectively accessing the contents therein;

a rocker plate pivotally mounted on a pivot axis within said enclosure and separating said chambers; said rocker plate being pivotable between a receiving position for receiving mail from said opening of said front end of said incoming chamber and a drop position for dropping received mail into said secured chamber; said rocker plate including:

a rear section on one side of the pivot axis having a back end adapted for controlling the communication of mail between said incoming chamber and said secured chamber; and a front section on the other side of the pivot axis having a front end disposed proximal said front end of said incoming chamber when said rocker plate is in the receiving position; said front section having a moment greater than the moment of said rear section so as to bias said rocker plate toward the receiving position;

stop means interacting between said enclosure and said rocker plate for stopping said rocker plate in the receiving position;

automatic drop means, interacting between said incoming chamber closure means and said front end of said front section of said rocker plate, for automatically pivoting said rocker plate to the drop position when said incoming chamber closure means is engaged to close the opening in said front end of said incoming chamber; and outgoing mail detention means including a detention plate pivotally attached to said rocker plate for preventing outgoing mail from dropping into said secured chamber.

22. A Security Mailbox for receiving mail comprising:

an enclosure having:

an incoming chamber including:

a front end having an opening therein; and closure means for selectively closing the opening in said front end of said incoming chamber; and a secured chamber having access means for selectively accessing the contents therein;

a rocker plate pivotally mounted on a pivot axis within said enclosure and separating said chambers; said rocker plate being pivotable between a receiving position for receiving mail from said opening of said front end of said incoming chamber and a drop position for dropping received mail into said secured chamber; said rocker plate including:

a rear section on one side of the pivot axis having a back end adapted for controlling the communication of mail between said incoming chamber and said secured chamber; and a front section on the other side of the pivot axis having a front end disposed proximal said front end of said incoming chamber when said rocker plate is in the receiving position; said front section having a moment greater than the moment of said rear section so as to bias said rocker plate toward the receiving position;

stop means interacting between said enclosure and said rocker plate for stopping said rocker plate in the receiving position; and outgoing mail detention means including a detention plate pivotally attached to said rocker plate for preventing outgoing mail from dropping into said secured chamber; said mailbox adapted such that a user's hand may lift up on said front section of said rocker plate and thereby pivot said rocker plate to the drop position.

* * * * *